US006189740B1

(12) United States Patent
Wade et al.

(10) Patent No.: US 6,189,740 B1
(45) Date of Patent: Feb. 20, 2001

(54) ANTISEPTIC SOAP DISPENSER WITH SELECTIVELY VARIABLE DOSE

(75) Inventors: Allan E. Wade, Manchester, MO (US); Keith D. Alsberg, Chicago, IL (US); Jon B. Taylor, Chicago, IL (US); James D. deBeers, Chicago, IL (US)

(73) Assignee: Steris Inc, Temecula, CA (US)

( * ) Notice: Under 35 U.S.C. 154(b), the term of this patent shall be extended for 0 days.

(21) Appl. No.: 09/237,221

(22) Filed: Jan. 25, 1999

Related U.S. Application Data

(60) Provisional application No. 60/114,226, filed on Dec. 30, 1998.

(51) Int. Cl.[7] ..... B65D 37/00

(52) U.S. Cl. ..... 222/207; 222/214; 222/101; 222/309

(58) Field of Search ..... 222/207, 214, 222/181.2, 181.3, 189.1, 101, 309

(56) References Cited

U.S. PATENT DOCUMENTS

| | | | | |
|---|---|---|---|---|
| 3,066,832 | * | 12/1962 | Rosseti | 222/207 |
| 3,288,332 | | 11/1966 | Jean-Claude Etter et al. | 222/80 |
| 3,881,641 | * | 5/1975 | Pliml, Jr. et al. | 222/207 |
| 4,130,224 | | 12/1978 | Norman et al. | 222/185 |
| 4,238,056 | | 12/1980 | Tucker et al. | 222/181 |
| 4,256,242 | * | 3/1981 | Christine | 222/207 |
| 4,269,330 | | 5/1981 | Johnson | 222/386 |
| 4,350,268 | | 9/1982 | Potter | 222/214 |
| 4,394,938 | | 7/1983 | Frassanito | 222/207 |
| 4,489,857 | | 12/1984 | Batlas | 222/179 |
| 4,560,093 | | 12/1985 | Cassia | 222/181 |
| 4,570,829 | | 2/1986 | Allen | 222/181 |
| 4,621,749 | | 11/1986 | Kanfer | 222/181 |
| 4,667,854 | | 5/1987 | McDermott et al. | 222/153 |
| 4,690,307 | | 9/1987 | Hogan | 222/95 |
| 4,715,517 | | 12/1987 | Potter et al. | 222/181 |
| 4,778,085 | | 10/1988 | Bush et al. | 222/207 |
| 4,807,484 | | 2/1989 | Darnell | 251/7 |
| 4,895,276 | | 1/1990 | Maldonado | 222/144.5 |
| 4,946,070 | | 8/1990 | Albert et al. | 222/105 |
| 4,946,072 | | 8/1990 | Albert et al. | 222/214 |
| 4,961,508 | | 10/1990 | Weimer et al. | 222/181 |
| 5,105,992 | | 4/1992 | Fender et al. | 222/185 |
| 5,183,182 | | 2/1993 | Comstock et al. | 222/129 |
| 5,209,377 | | 5/1993 | Steiner et al. | 222/189 |
| 5,265,772 | | 11/1993 | Bartasevich et al. | 222/214 |
| 5,326,033 | | 7/1994 | Anfindsen | 222/61 |
| 5,377,871 | | 1/1995 | Banks et al. | 222/41 |
| 5,421,489 | | 6/1995 | Holzner, Sr. et al. | 222/207 |
| 5,431,309 | | 7/1995 | Ophardt | 222/181.3 |
| 5,439,144 | * | 8/1995 | Holzner | 222/189.06 |
| 5,556,005 | | 9/1996 | Banks | 222/96 |
| 5,595,324 | | 1/1997 | Brown et al. | 222/1 |

* cited by examiner

*Primary Examiner*—Kevin Shaver
*Assistant Examiner*—Melvin A. Cartagena
(74) *Attorney, Agent, or Firm*—Fay, Sharpe, Fagan, Minnich & McKee, LLP

(57) ABSTRACT

An antiseptic soap dispenser has a dispensing system (28) which includes a pressure actuated platen (32) and a moveable roller (94) for dispensing soap from a replaceable container (12). A dispensing tube (10) with an integral self-sealing valve (40) at a downstream end is connected to a neck (20) of the container. Hand pressure on the platen compresses a upstream end of the dispensing tube between the platen and the roller. With increasing pressure, the roller moves progressively down the tube to dispense soap through the valve. A volume regulator (111) controls the amount of soap dispensed. The platen returns quickly to its at-rest position once the pressure is removed, avoiding complete compression of the pathway by the roller. This minimizes air ingress, and resultant contamination of the soap. Optionally, a filtered vent (14) in a wall (22) of the container allows filtered air to enter the container in place of the soap dispensed.

21 Claims, 10 Drawing Sheets

ANTISEPTIC SOAP DISPENSER WITH SELECTIVELY VARIABLE DOSE

This application claims the priority of U.S. Provisional Application Ser. No. 60/114,226, filed Dec. 30, 1998.

BACKGROUND OF THE INVENTION

The present invention relates to the dispensing arts. It finds particular application in conjunction with antiseptic soap dispensers for accurately dispensing discrete doses of soap, hand lotions, creams, and the like, into the palm of a user, and will be described with particular reference thereto. It should be appreciated, however, that the invention is also applicable to the dispensing of other fluid, viscous, and pasty materials, such as food products, where accurate dosage is desired.

Hand-operated dispensers are widely used for delivery of liquid soaps, hand lotions, creams, and the like. These are typically mounted on a wall and consist of a housing and a dispensing mechanism. The fluid is stored in a replaceable reservoir, such as a plastic container, within the housing and delivered, as needed, by actuating the dispensing mechanism.

A wide variety of dispensing mechanisms have been developed for dispensing discrete doses of fluid. One type of dispenser employs a resiliently flexible dispensing tube or pathway which is compressed between two rigid members to deliver the fluid. U.S. Pat. No. 4,667,854 to McDermott, et al., U.S. Pat. No. 4,178,975 to Crespi, and U.S. Pat. No. 5,377,871 to Banks, et al. disclose dispensers in which one of the rigid members is a roller. The roller of McDermott, et al., for example, is mounted on an arm of a Y-shaped cam. The other arm of the Y is spring biased. Pressure on a bar on the front of the dispenser causes the cam to rotate and the roller is urged against an upper end of a flexible tube, compressing the tube between the roller and a block. Continued pressure on the bar causes the roller to move progressively down the tube, forcing the liquid out of the end of the tube as it descends. When the bar is released, the spring returns the roller and cam to their original positions.

A user operating such dispensers typically holds the palm of the hand beneath the dispenser to receive the dose of soap. However, during actuation of the dispenser, the palm of the hand generally moves relative to the end of the flexible tube, and some of the soap may not be received in the palm. Wastage of soap often results. More importantly, for antiseptic soaps, decontamination is only assured when a complete dose is applied to the hands. Soap that trickles through the fingers or misses the hand completely does not contribute to thorough decontamination.

In addition, conventional roller-type dispensers suffer other disadvantages. Typically, the roller follows a return path that is the reverse of the path traveled during dispensing. Thus, the roller moves back up the flexible tube, compressing the tube. This tends to draw air into the tube behind the roller. It is desirable to keep air which may be contaminated with external bioburden out of the container. Although the soaps generally contain preservatives, these may be overwhelmed if an excess of bioburden enters the container and remains in contact with the soap for an extended period.

Such a return path also lengthens the time between actuations of the dispenser. Until the roller has returned to the at-rest position, leaving the top of the tube open, soap does not begin to flow down from the container into the tube, ready for further dispensing. If the dispenser is, actuated before the tube has refilled, an incomplete dose will be administered and decontamination cannot be guaranteed.

For some antiseptic soaps, a sizable dose is recommended for complete decontamination. Most dispensers have a fixed nominal dose which is dispensed in a single actuation. When larger doses are required, the dispenser is typically provided with a notice, directing the user to dispense two or more shots of the soap. This is not only time consuming, but often results in an insufficient dose. Because the dispenser frequently takes a few seconds for the pathway to refill, the second actuation will not yield the desired dose if initiated too quickly.

To overcome this problem, some dispensers provide a volume regulator, which allows for different size doses to be dispensed. U.S. Pat. Nos. 4,778,085 to Bush, et al. and 3,288,332 to Etter, et al. disclose examples of such volume regulators. To allow for different size doses and different soap viscosities, volume regulators tend to be infinitely adjustable between minimum and maximum settings. The operator who sets the regulator may therefore set it too low, resulting in an inadequate dose, or too high, resulting in unnecessary wastage of soap. Moreover, a user may subsequently adjust the regulator for a smaller dose and fail to return the regulator to the correct setting for assured decontamination.

There remains a need, therefore, for soap dispenser which dispenses discrete doses of soap accurately and reproducibly, without ingress of potentially contaminated air into the dispenser. The present invention provides a new and improved soap dispenser which overcomes the above-referenced problems and others.

SUMMARY OF THE INVENTION

In accordance with one aspect of the present invention, a dispenser for discharging a liquid is provided. The dispenser includes a housing including a front cover and a back plate. A reservoir, for containing the liquid, is removably mounted within the housing. The reservoir includes a container and a flexible tube connected at an upstream end to the container. A valve selectively closes a downstream end of the tube. A roller assembly is pivotally mounted in the housing, and includes a roller bar rotatably mounted on an assembly body. A platen is moveably connected to the front cover of the housing such that pressure on the platen moves the platen towards the roller assembly, the platen compressing the upstream end of the tube between the platen and the roller bar and camming the roller bar towards the downstream end of the tube.

In accordance with another aspect of the present invention, a method of dispensing an antiseptic liquid from a reservoir without drawing contaminated air into the reservoir is provided. The method includes compressing a flexible tube between a platen and a roller to seal off an upper portion of the tube, the tube being connected at an upper end to the reservoir of the liquid and having a valve at a lower end. The method further includes moving the roller progressively down the tube toward the downstream end, the tube being compressed progressively adjacent the roller, the roller exerting a pressure on the liquid at the downstream end of the tube which causes the valve to open to dispense the liquid. The method further includes removing the compression on the tube adjacent the downstream end of the tube such that liquid drawn from the reservoir into the tube behind the roller remains in the tube and blocks ingress of air through the valve.

One advantage of the present invention is that it dispenses measured doses of an antiseptic soap.

Another advantage of the present invention is that external bioburden is not drawn into the tube. The soap remaining in the tube contributes to blocking ingress of air into the dispenser as the dispensing mechanism returns to its at-rest position.

Yet another advantage of the present invention is that the dispenser has a short recycle time, allowing accurate dispensing of soap at frequent intervals.

Still another advantage of the present is that both small and large doses of soap may be dispensed with a high degree of reproducibility.

A further advantage of the present invention is that a low actuation force dispenses soap from the dispenser.

A yet further advantage of the present invention is that the dispenser provides for minimal distortion and wear of the flexible tube.

Still further advantages reside in that the soap is dispensed directly into the users hand, assuring that a full dose is applied and soap is not wasted.

Still further advantages of the present invention will become apparent to those of ordinary skill in the art upon reading and understanding the following detailed description of the preferred embodiments.

BRIEF DESCRIPTION OF THE DRAWINGS

The invention may take form in various components and arrangements of components, and in various steps and arrangements of steps. The drawings are only for purposes of illustrating a preferred embodiment and are not to be construed as limiting the invention.

DETAILED DESCRIPTION OF THE PREFERRED EMBODIMENTS

Figure 1:
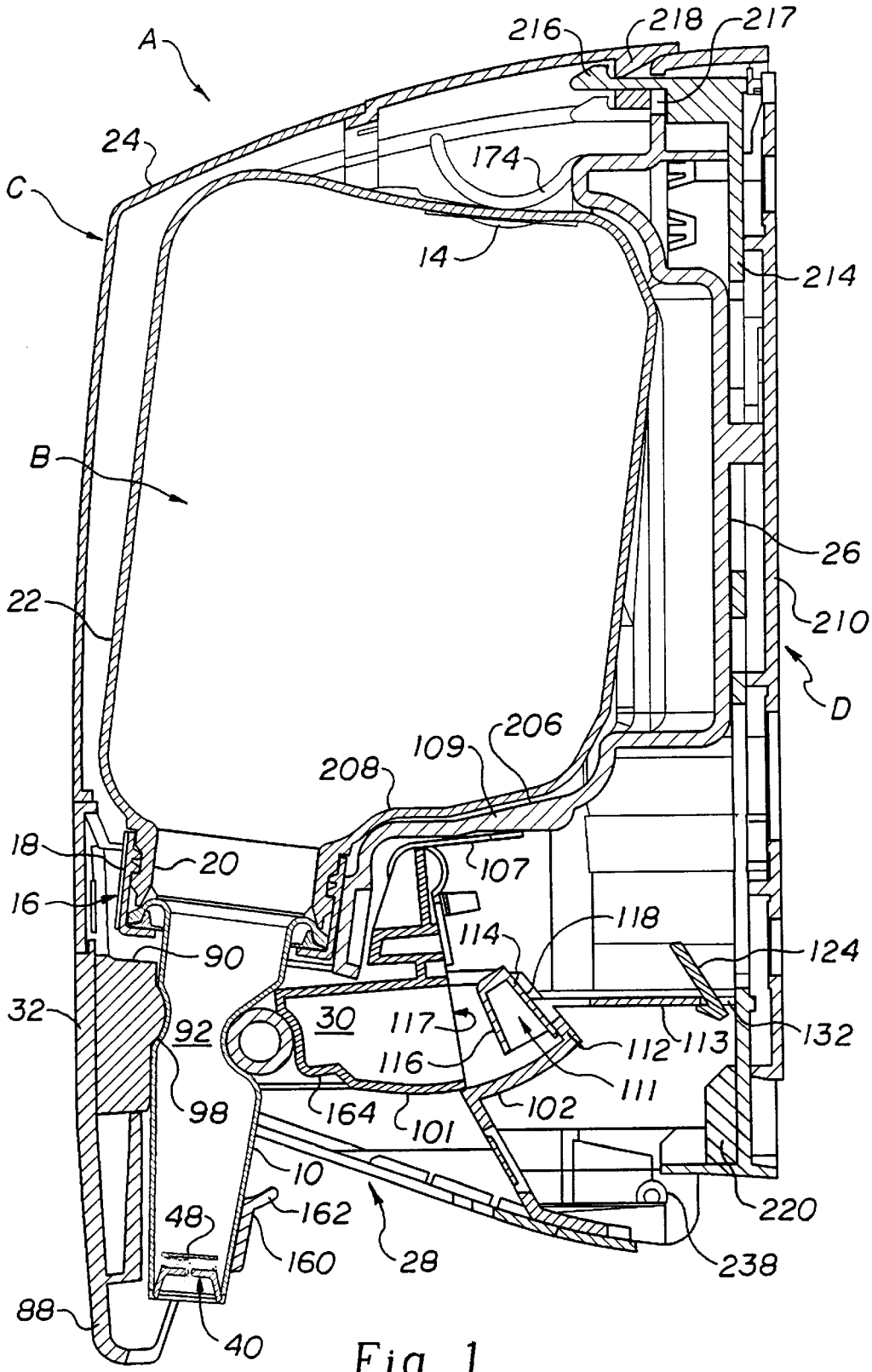
FIG. 1 is a side sectional view of a soap dispenser with the platen in a rest position, according to the present invention.
Figure 2:
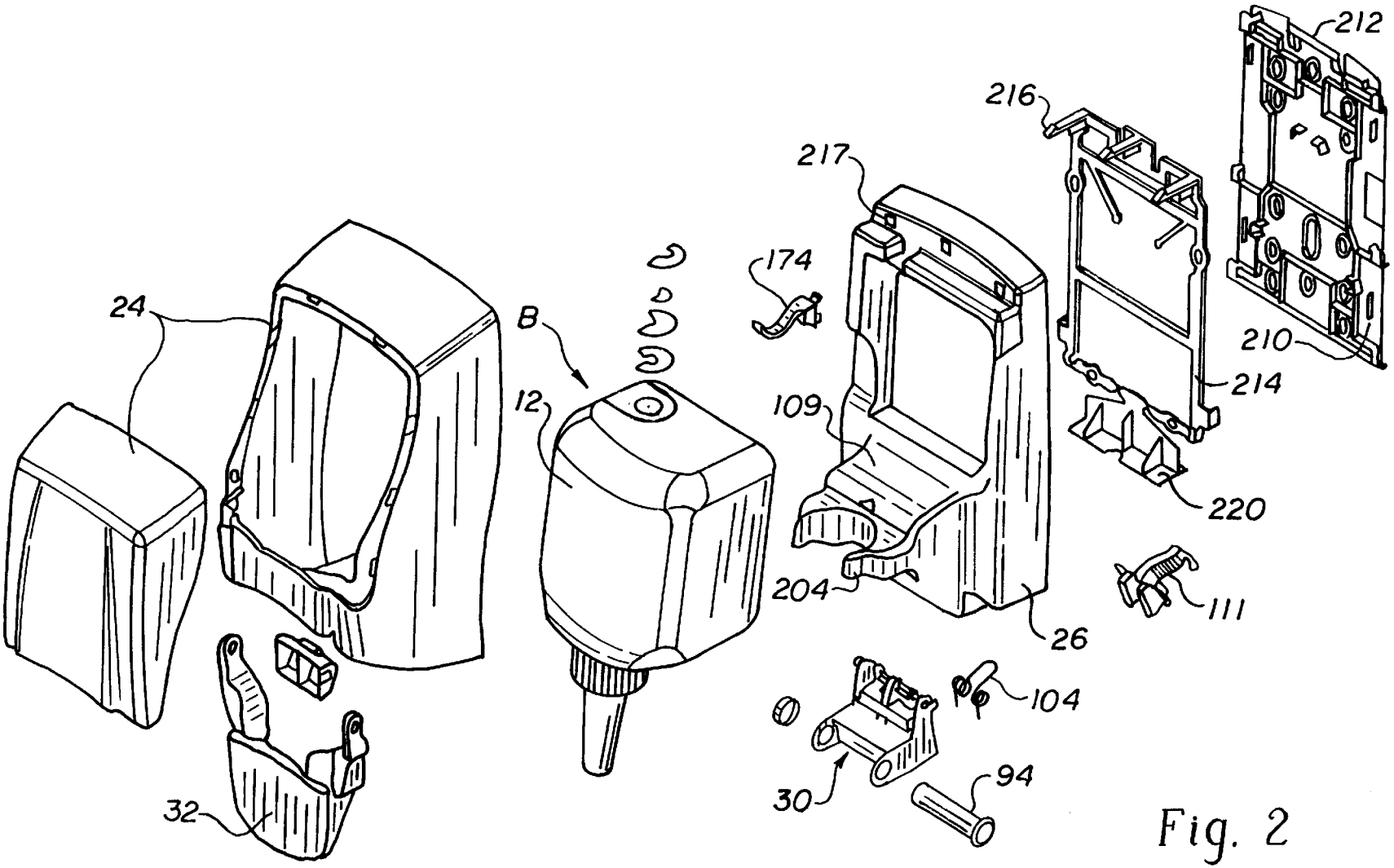
FIG. 2 is an exploded perspective view of the dispenser of FIG. 1.
Figure 3:
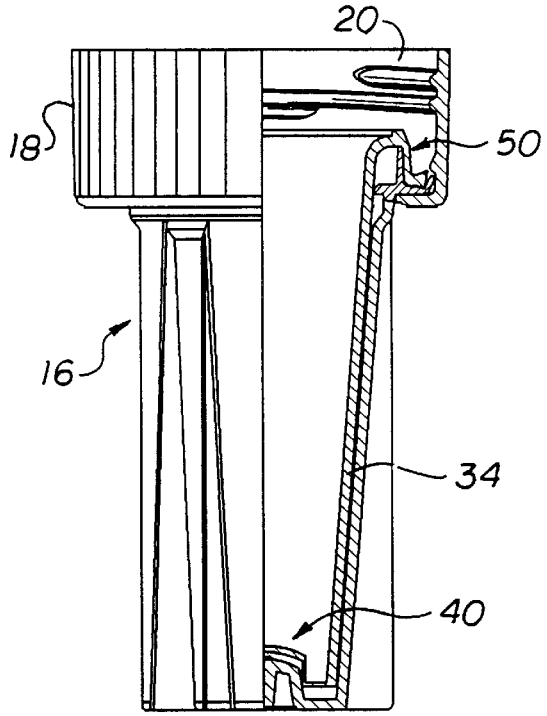
FIG. 3 is an enlarged side cutaway view of the pathway and cap assembly of FIG. 1.
Figure 4:
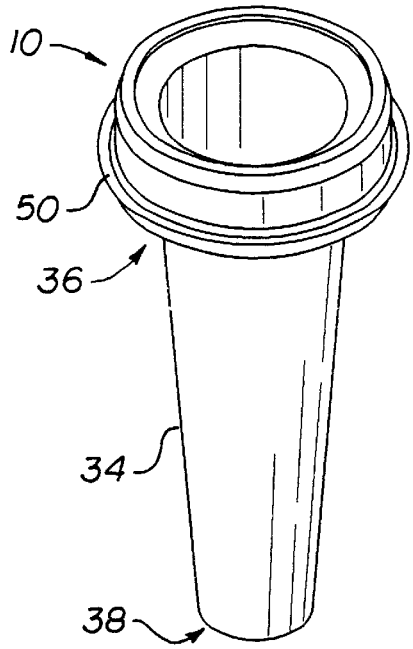
FIG. 4 is an enlarged perspective view of the pathway of FIG. 1.

With reference to FIGS. 1 and 2, an antiseptic soap dispenser A includes a replaceable soap reservoir B. The reservoir includes a dispensing tube, or pathway 10, a container 12 which holds an antiseptic soap or other cleaning fluid to be dispensed, a filtered air vent 14, and a cap assembly 16. The cap assembly 16 includes a cap 18 which connects the pathway 10 to a neck 20 defined by an exterior wall 22 of the container 12.

The dispenser also includes a housing C, which has a front cover 24 and a back plate 26. The front cover is pivotally connected to the back plate and pivots open to allow the soap reservoir to be replaced. A wall mounting system D mounts the dispenser to a wall or other suitable mounting surface. A dispensing system 28 is supported by the housing C. The dispensing system 28 includes a pivoted dispensing roller assembly 30 and a tube compressing platen 32. The operation of the dispensing system will be described in greater detail below.

For ease of reference, the dispenser will be described with particular reference to the dispensing of antiseptic soaps. It should be appreciated, however, that the dispensing of other fluids and pasty materials is also contemplated.

With continued reference to FIG. 1, and reference also to FIGS. 3–6, the pathway, or dispensing tube 10 is approximately 5–8 cm in length and has side walls 34 which taper inwardly from a top portion, or upstream end 36, adjacent the container 12, towards a dispensing, or downstream end 38 of the pathway. The taper is preferably 0–15° from the vertical, with a particularly preferred taper of 4–6°. The pathway material is one which does not have a memory i.e. it can be compressed and then returns to it original shape very quickly, when released. This allows the pathway to refill rapidly with the dispensing fluid. A preferred material for the pathway is silicone rubber, although other resiliently flexible materials are also contemplated.

Figure 5:
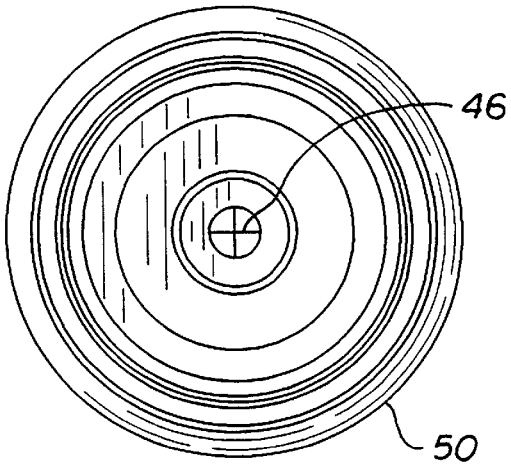
FIG. 5 is an enlarged top view of the pathway of FIG. 1.
Figure 6:
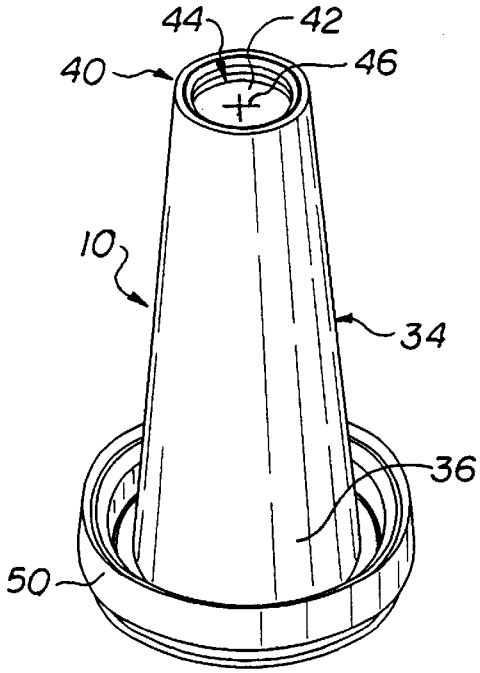
FIG. 6 is an enlarged perspective inverted view of the pathway of FIG. 1.

At the downstream end 38 of the pathway is a closure, such as a self sealing valve 40, shown most clearly in FIG. 5. The cooperative action of the valve 40 and the dispensing system 28 limits air ingress into the dispenser container 12 through the pathway 10 and thereby prevents bioburden entering into the soap product.

The valve 40 includes a diaphragm 42 which is attached to the walls 34 of the pathway 10 by side members 44. Under normal static pressure of the fluid, the side members project inwardly, into the interior of the pathway. When the pathway is squeezed by the dispensing system 28, the increased pressure on the fluid adjacent the valve forces the side members to roll outwards until the diaphragm bulges outwards. A slit 46, preferably in the shape of a cross, is disposed at the center of the diaphragm. When the diaphragm bulges outward, the slit opens and fluid passes from the pathway. Although the self sealing valve 40 is a preferred method of sealing the pathway 10, other closure means are also contemplated.

When the pressure is released, the side members 44 and diaphragm 42 roll and retract back to a rest position. In the rest position, the slit 46 is closed and fluid no longer leaves or enters the pathway through the valve 40. Optionally, a valve seat 48, shown in FIG. 1, supports the diaphragm in the rest position and prevents the slit valve from flexing inward and admitting unfiltered air into the pathway. The valve seat 48 ensures that the slit 46 in the diaphragm 42 only opens outward under the pressure of fluid when the dispensing system 28 is actuated. The top 36 of the pathway defines a lip 50 which is sealed to the neck 20 by the cap 18.

Figure 7:
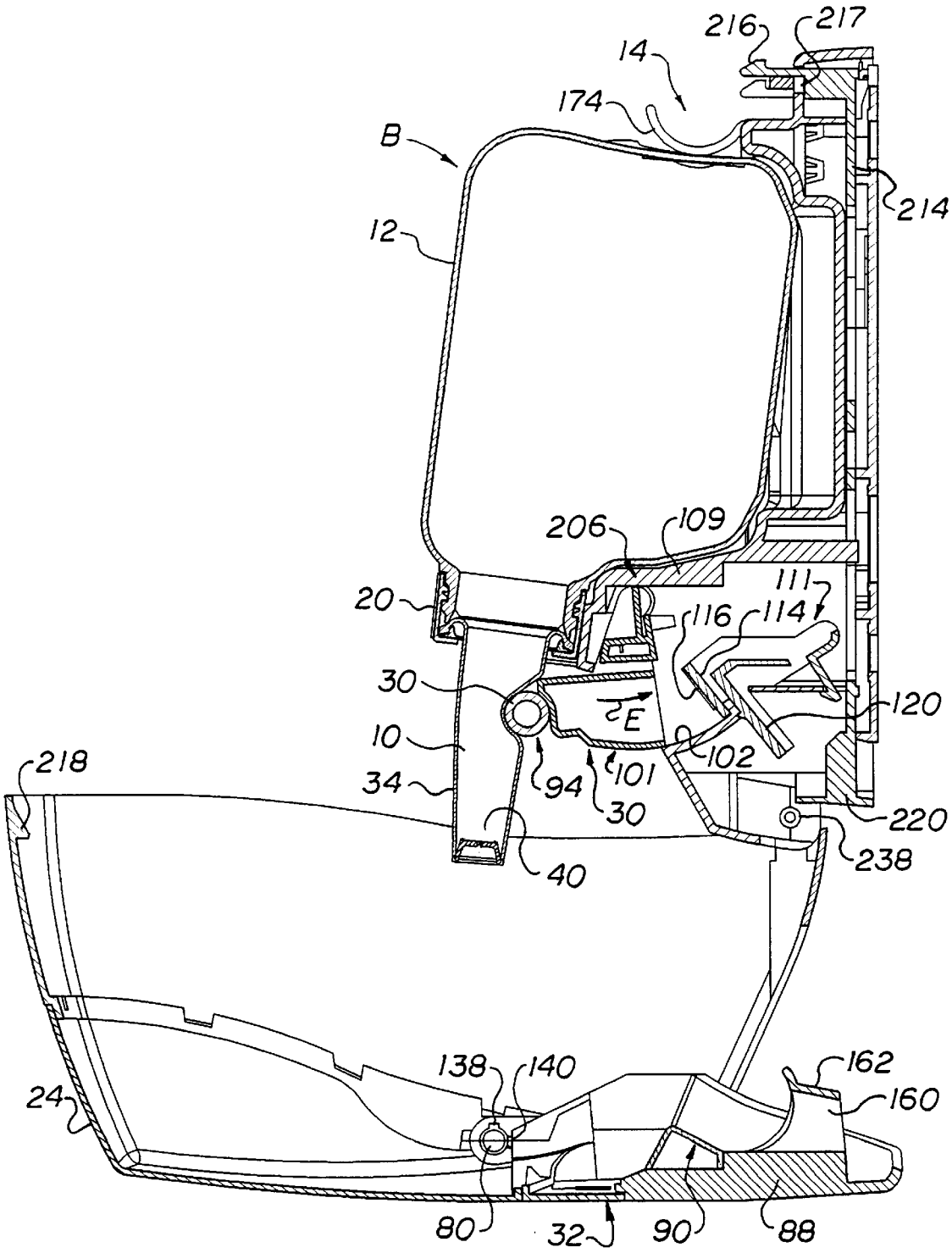
FIG. 7 is a side sectional view of the dispenser of FIG. 1 with the front cover open.
Figure 8:
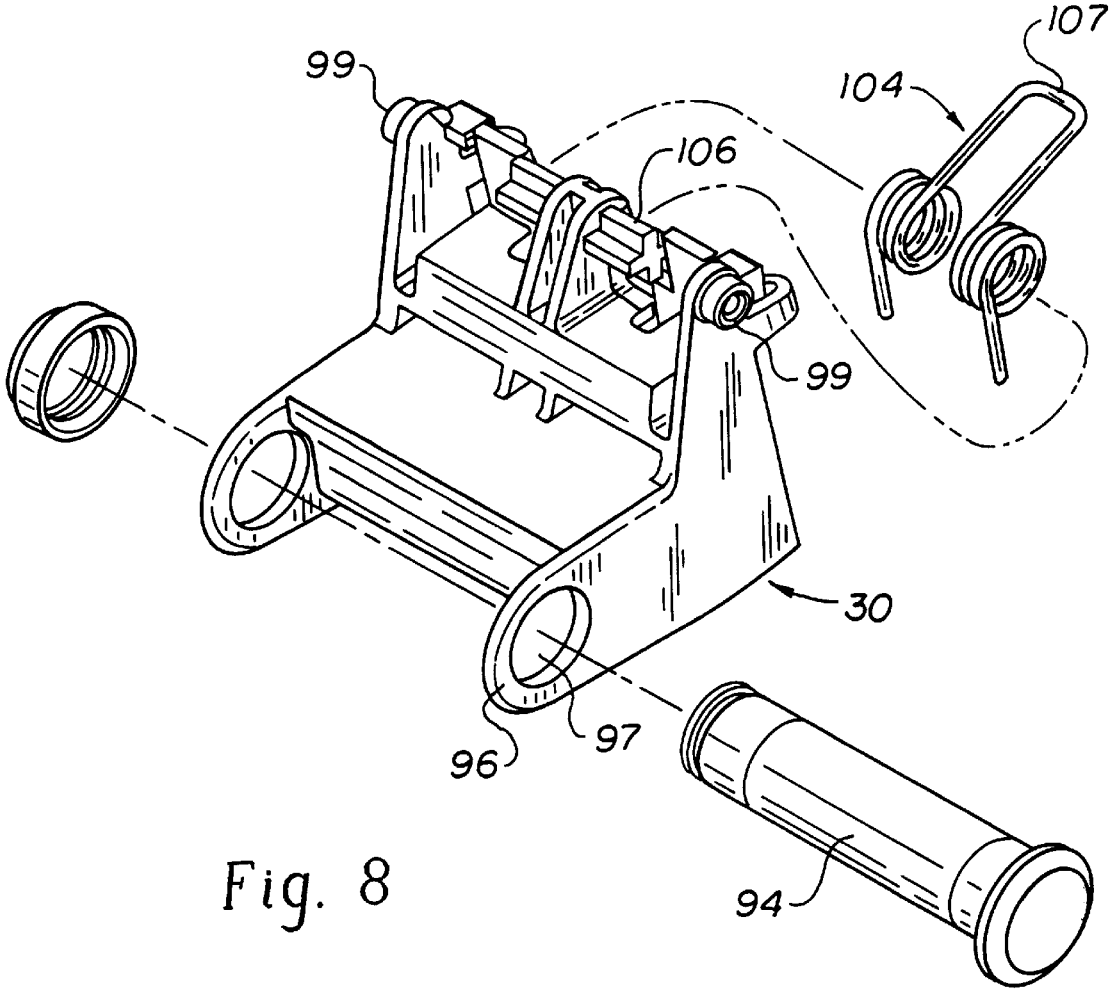
FIG. 8 is an enlarged exploded perspective view of the roller assembly of FIG. 1.
Figure 9:
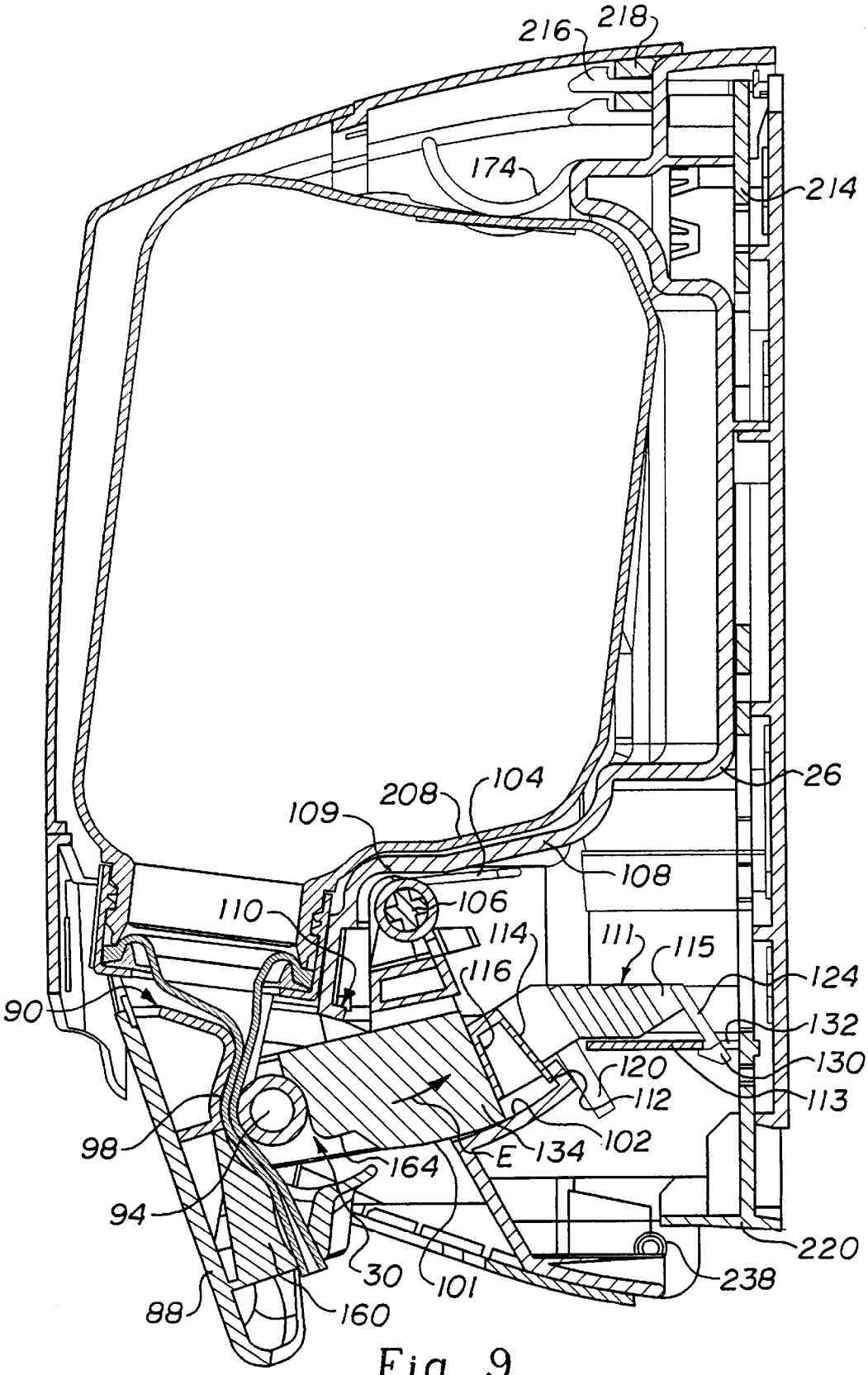
FIG. 9 is a side sectional view of the dispenser of FIG. 1, with the platen in the depressed position and the roller assembly fully retracted.

With continued reference to FIG. 1, and reference also to FIGS. 7–9, the dispensing system 28 dispenses measured doses of cleaning fluid. The cleaning fluid is ejected through the valve 40 at the end of the pathway 10. A typical dispensing cycle includes an actuation stroke, in which cleaning fluid is dispensed, and a return movement, in which the moveable parts of the dispensing system return to their at-rest positions.

The platen 32 is preferably of a push bar type, designed to be depressed with minimal force. The platen pivots around a pivot point 80, on the front cover 24 of the dispenser housing C, best shown in FIG. 7. The platen returns to its at-rest position when pressure is released due to the resiliency of the pathway. A spring (not shown, at pivot 80) is optionally provided for returning the platen to the at-rest position when the dispensing tube is absent, for example during replacement of the reservoir B.

The platen includes a depression plate or bar 88 which is formed from a relatively rigid material, such as metal or plastic. When the platen is in the at-rest position, the depression plate is vertically aligned with the front cover of the housing. A projection 90 extends rearwardly from the depression plate 88 such that, when the platen is in the at rest position, the projection is adjacent, or slightly depressing, the sidewall 34 of the pathway 10. During the actuation stroke, the depression plate 88 is depressed by the user in the direction of the roller assembly 30. The projection 90 compresses a central region 92 of the pathway 10 between the projection and the pivotable roller assembly 30, closing off an upper end of the pathway.

FIG. 1 shows the roller assembly 30 positioned approximately as it would be in the at-rest position, at the start of an actuation stroke. With reference also to FIGS. 8 and 9, the roller assembly 30 includes a cylindrical roller bar 94, rotatably mounted between a pair of supporting flanges 96 which extend forwardly on the roller assembly. Circular openings 97 in the flanges receive ends of the roller bar. In the at-rest position, the roller bar is positioned such that it depresses the pathway 10 only slightly, or not at all. The pathway 10 engages the roller bar more firmly as the platen 32 is depressed. The roller bar 94 is preferably constructed of a smooth plastic. Alternatively, it may be slightly roughened to reduce friction between the roller bar and the pathway 10.

With particular reference to FIG. 1, the roller assembly 30 is positioned at a slightly downward angle, relative to the horizontal, so that during the actuation stroke, the roller bar 94 rolls downward along a camming surface 98 on the platen projection 90. Continued pressure on the depression plate 88 causes the roller bar to descend along the pathway 10, in the direction of the valve 40, as shown in FIG. 9. The pathway is squeezed progressively down its length by the pressure of the roller bar 94 on the platen. In this manner, a dose of the cleaning fluid is dispensed from the pathway.

The downward motion of the roller bar 94 draws additional cleaning fluid into an upper portion of the pathway 10, behind the roller bar. This provides for a rapid recycle time between dispensing and reduces the tendency for outside air to enter the pathway.

Figure 10:
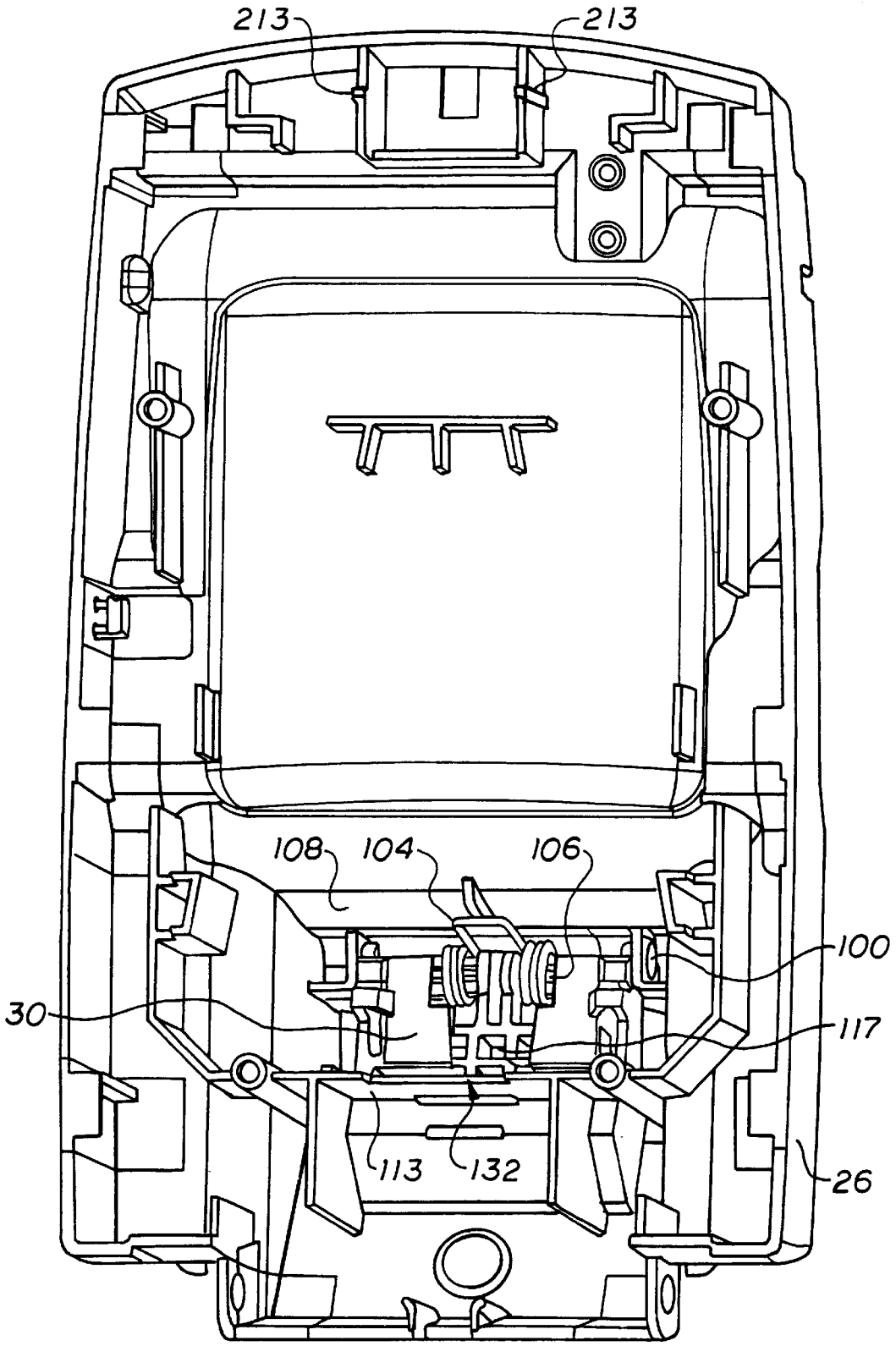
FIG. 10 is a rear perspective view of the dispenser of FIG. 1, with a regulator removed for clarity.

In addition to the downward motion during the actuation stroke, the roller assembly 30 also pivots rearwardly, in the direction of arrow E, as shown in FIGS. 7 and 9. Specifically, the roller assembly is pivotally mounted to the back plate 26 by a pair of pivot pins 99 at pivot points 100 as shown in FIGS. 8 and 10. A lower surface 101 of the roller assembly 30 slides along an adjacent sliding surface 102 mounted in the rear of the housing C during pivoting, as shown in FIGS. 7 and 9.

With reference to FIGS. 8 and 9, the roller assembly 30 includes a spring-loaded return mechanism, such as a spring 104, so that when the pressure on the platen 32 is released, the roller assembly returns to its original position (FIG. 1). The spring is formed from a piece of wire which is coiled adjacent either end. Each of the coils is received around a horizontal shaft 106 on the top of the roller assembly.

A central portion 107 of the spring extends rearwardly and upwardly from the roller assembly and engages a biasing surface, such as an adjacent lower surface 108, of a generally horizontal support 109 for the container 12, which is defined by the back plate 26. When the roller is pushed rearwardly during the actuation stroke, the central portion 107 of the spring is biased by the lower surface 108. This biases the roller assembly so that it is compressed against the pathway during the actuation stroke. The biasing force developed in the spring returns the roller assembly to its at-rest position once the rearward pressure is removed. A forward stop 110, defined by the back plate 26, engages the roller assembly in the at rest position, preventing the roller bar 94 from squeezing the pathway 10 unduly.

Once the pressure on the platen 32 is removed, the resiliency of the dispensing tube and the pressure of the fluid therein returns the platen to the at-rest position at a faster rate than that of the returning roller assembly 30. The roller therefore returns to its at-rest position without unduly compressing the pathway.

This cyclical "kneading action" allows the pathway 10 to retain fluid drawn into the pathway during the actuation stroke by the downward motion of the roller bar 94 and allows the pathway to refill rapidly with the fluid. The dispenser thus has a short cycle time, in that the platen 32 can be pressed repeatedly without significant reduction in the volume of cleaning fluid which is dispensed. Conventional dispensers frequently dispense successively smaller volumes of cleaning fluid with each succeeding rapid depression. Reproducibility of the volume of cleaning fluid is particularly important for cleaning fluids which are formulated such that a specific volume of the fluid assures thorough cleaning and disinfection.

Moreover, the kneading action of the roller assembly 30 and platen 32 described above, helps to prevent air from entering into the pathway 10, which otherwise could cause contamination of the cleaning fluid by importation of airborne contaminants into the container 12. The filtered vent 14, described in detail below, allows filtered air into the container to replace the fluid dispensed.

Figure 11:
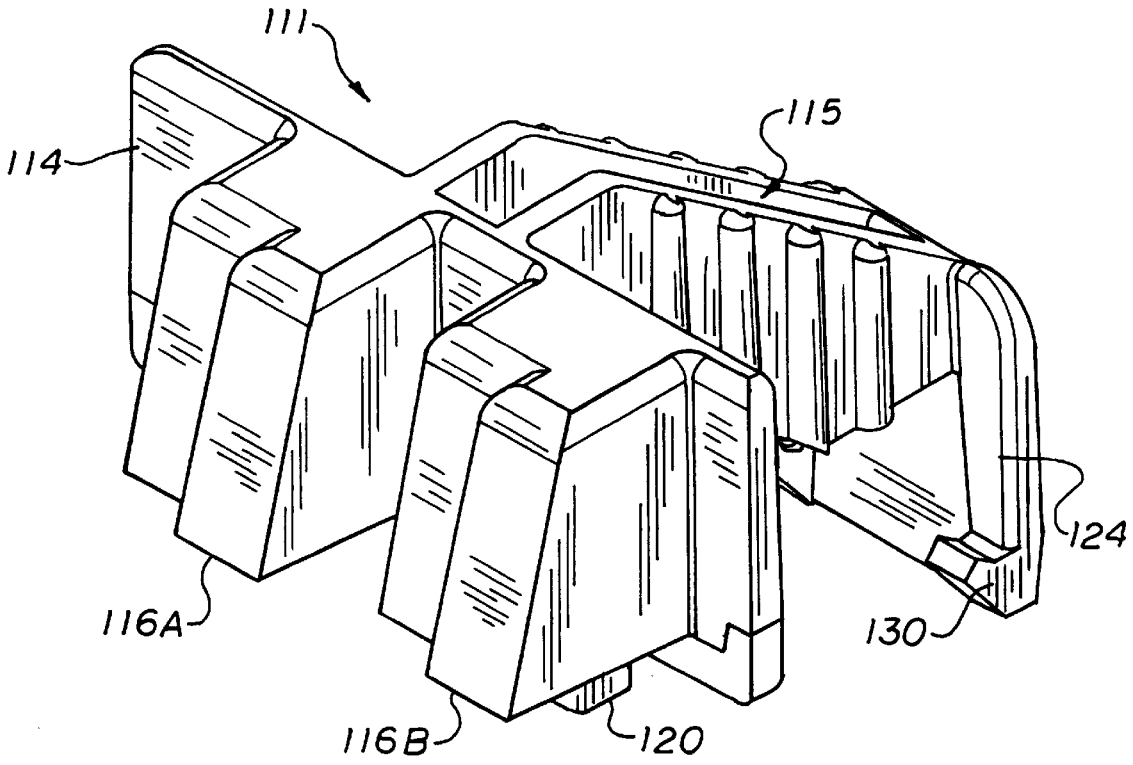
FIG. 11 is an enlarged perspective view of the volume regulator of FIG. 1.

With continued reference to FIGS. 1, 8, 10, and reference also to FIG. 11, the dispenser accurately dispenses a preselected volume of cleaning fluid of between about 1 ml and about 3 ml. A dispense adjuster, or volume regulator 111, shown in greater detail in FIG. 11, acts to stop the movement of the roller assembly 30 at a preselected fixed position. The volume regulator is movably mounted on an upturned rearward portion 112 of the sliding surface 102, and rests on a horizontally extending housing member or shelf 113, which is defined by a rear surface of the back plate 26 and is connected at a forward end to the uprturned portion 112 of the sliding surface, shown most clearly in FIG. 10.

The volume regulator 111 has a number of discreet preset fixed positions which determine the volume of the fluid to be dispensed with a single press of the platen. Preferably, there are three such fixed positions, which nominally dispense 1 ml, 1½ ml, and 2½ ml, respectively. In this way, the volume regulator can be adjusted so that a preselected volume of cleaning fluid is dispensed by a single press of the platen. Specifically, the volume regulator 111 includes a stop plate 114 and a body portion 115, which is connected at a forward end to the rear of the stop plate. Two (or more) sets of steps 116A and 116B, extend forwardly of the stop plate, each of the steps having a different preselected depth to arrest the rearward motion of the roller assembly at one of the three positions by engaging one or more rearward facing surfaces 117 of the roller assembly 30. The volume regulator 111 preferably includes dual sets of steps 116A and 116B, creating a positive stop for each of the selectable volumes.

The stop plate 114 projects forwardly of the rearward portion 112 of the sliding surface. Specifically, the volume regulator is movably mounted such that the rearward portion 112 is gripped between a rear face 118 of the stop plate and a first lower arm 120 (or pair of arms) which depends from the body portion 115 of the volume regulator 111.

To adjust the volume dispensed, the volume regulator 111 is moved transversely with respect to the roller assembly 30. Specifically, a pair of bumps (not shown) protrude from the rear face 118 of the stop plate, one on either side of the rear face. Each of the bumps engages a selected one of a set of three dimples (not shown). Each of the sets of dimples is defined in a forward face of the upturned portion 112 of the sliding surface. Depending on the dimples selected, one of the steps 116 is positioned so that it is aligned with the rear surface 117 of the roller assembly 30.

A second lower arm, or preferably a pair of arms 124, depends from a rear of the body portion 115 of the volume regulator 111, to assist in positioning the volume regulator. A detent 130 extending forwardly from a distal end of each of the second lower arms 124 releasably engages a lower surface of the shelf 113 when the second lower arms are inserted in a transverse slot or groove 132 in the rear of the shelf.

Repositioning of the volume regulator 111 is best achieved when the front cover 24 is open as shown in FIG. 7. Alternatively, the back plate 26 may be removed for easier access to the regulator. When a new reservoir B is inserted into the dispenser, the operator sets the volume regulator according to instructions on the reservoir, which are dependent on the type of product to be dispensed. Access to the volume regulator is preferably prevented when the front cover is closed, reducing the risks of tampering with the adjuster or accidental readjustment.

A nominal setting of, for example, 1 ml delivers a reproducible amount of a specific cleaning fluid. For volumes of about 1 ml and above, the reproducibility of the amount dispensed is ±5% for a chosen cleaning fluid. Thus, antimicrobial soaps, and the like, which have a specified quantity for the assured kill of micro-organisms, can be accurately dispensed in a single "shot"—or actuation stroke.

With reference to FIGS. 1 and 7, the platen 32 includes a tubular-shaped retaining portion 160 at its lower end which receives the pathway 10. The retaining portion holds the lower end of the pathway in a fixed position, relative to the platen, throughout the dispensing cycle. The pathway therefore travels with the hand of an operator during dispensing. Typically, the platen is pressed with the ball of the hand while the palm is held underneath the platen, ready to receive the cleaning fluid, although other methods of actuation are possible. By fixing the pathway to the platen, the palm is beneath the valve during the entire actuation stroke, ensuring that the cleaning fluid dispensed is not wasted, and that the full dose is available for cleaning the operator's hands.

The retaining portion 160 also assists in aligning the container 12 and pathway 10 in the dispenser. The soap container is simply lowered into the dispenser and the pathway self-aligns in the retaining portion. A retaining portion flange 162 extends outwardly from the retaining portion. The flange 162 is shaped to engage a stop surface 164 on the roller assembly 30 during actuation to limit downward motion of the roller.

Figure 12:
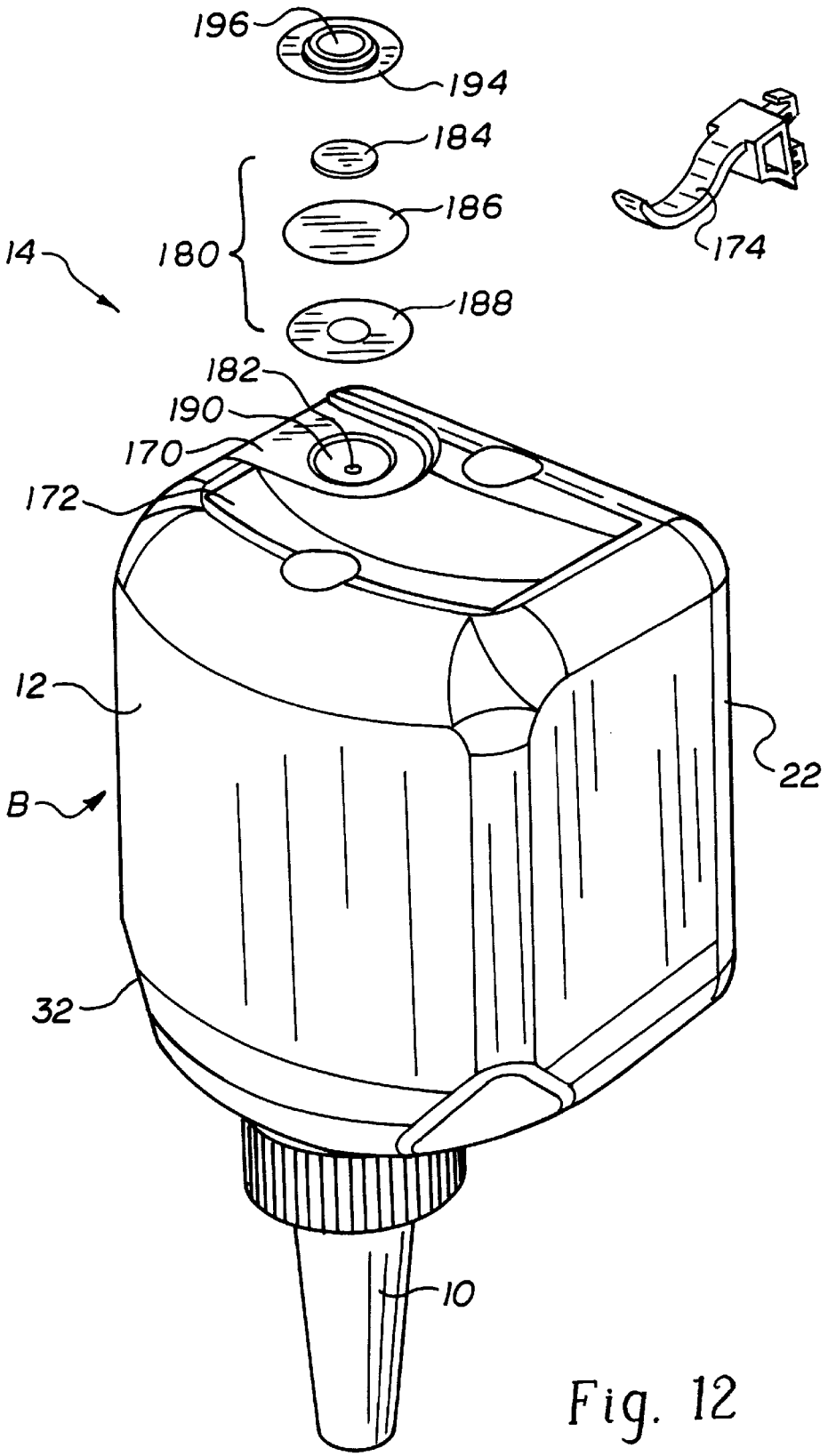
FIG. 12 is an exploded perspective view of the dispensing container and filtered vent of FIG. 1.

With reference to FIGS. 1 and 12, the filtered vent system 14 allows air to enter the container 12 to replace soap as it is dispensed. The vent system removes bioburden, such as particles of dust and microorganisms, from the air as it enters the container. The container is preferably formed from a relatively rigid material, such as polyethylene or polypropylene. The filtered air entering the container quickly returns the pressure in the atmosphere above the soap within the container 12 to atmospheric pressure as soap is dispensed. This reduces the suction effect which would otherwise tend to draw unfiltered air into the pathway at the completion of the actuation stroke. The vent therefore cooperates with the dispensing system 28 to reduce the possibility of unfiltered air entering the pathway and the container. The vent also assists in ensuring that a full dose is dispensed with each actuation by minimizing the amount of air entering the pathway.

Alternatively, the container 12 is formed from a non-rigid material which collapses as soap is dispensed. For non-rigid containers 12, the vent system may be eliminated, because the container walls progressively collapse as the soap is dispensed.

The vent system 14 is preferably disposed in an indented region 170 in a top portion 172 of the container wall 22. The indentation protects the vent system from accidental activation during shipment and storage of the container. When the front cover 24 of the dispenser is closed, it depresses a detent 174 so that it engages the vent system. The vent system 14 includes a filter system 180, which covers an opening 182 in the top portion of the container wall.

In one preferred embodiment, shown in FIG. 12, the filter system 180 comprises three layers which selectively seal the opening during storage and allow filtered air to pass into the container to replace cleaning fluid as it is dispensed. The layers are a top, or filter layer 184 formed from an expandable filter material, such as polytetrafluoroethylene (PTFE), an intermediate, or barrier layer 186 of aluminum foil or other occlusive material which is non-reactive with the cleaning fluid in the reservoir B, and a lower, or bonding layer 188 of which bonds readily to the top portion of the container wall around the opening 182. Where the container is formed from polyethylene, the bonding layer is preferably formed from a polyethylene film. The filter layer 184 filters out particles from incoming air down to about 0.3 microns. The barrier layer 186 prevents ingress of air into the container during transportation and storage and also prevents blocking of the filter with deposits from the cleaning fluid. The layers 184, 186, 188 are bonded to the container wall around a depression 190 in the wall which surrounds the opening 182.

When depressed by the action of the detent 174, the aluminum and polyethylene layers 186, 188 stretch and crack. The filter layer 184, may occupy only a central region of the filter system 180. It stretches without cracking and then acts as a filter for air entering the container. An additional, annular layer 194 with a central opening 196 extends in a ring around the outer edge of the filter layer 184 to ensure that air entering the container passes through the filter layer. The annular layer 194 is formed from an extensible material which does not fracture when the detent presses on the filter system 180.

With reference to FIGS. 1, 2, and 7, the reservoir B is supported in the housing C by the back plate 26. In particular, a semicircular collar 204, best shown in FIG. 2, extends forwardly from the back plate shelf 109 and receives the neck 20 of the container 12. The shelf 109 preferably has an undulating upper surface 206 which receives a similarly shaped lower portion 208 of the wall 22 of the container, to assist in seating the reservoir B in the housing C.

With continued reference to FIGS. 1 and 2, the wall mounting system D includes a wall mounting plate 210, which mounts the back plate 26 of the dispenser housing on a wall, or other suitable mounting surface. Preferably, a resiliently flexible hoop 212 on the mounting plate (see FIG. 2) lockably engages a pair of barbs 213 on a rear surface of the backplate (see FIG. 10) to prevent unauthorized removal of the back plate and the rest of the dispenser. To release the back plate, a rearward pressure is applied to the hoop 212, releasing the barbs and the backplate from engagement.

With reference to FIGS. 2, 7, and 9, the dispenser preferably includes a secure system of locking the front cover 24 to the back plate 26, preventing removal of the reservoir B and tampering with the volume regulator 111. One preferred locking system includes a latch plate 214, movably carried by the backplate. The latch plate includes latching hooks 216, which are mounted to an upper surface of the latch plate and are received through corresponding openings 217 at the upper end of the back plate such that they protrude forwardly. When the front cover 24 is closed, tabs 218 on an inner surface of the front cover engage the latching hooks. To release the engagement, an extension 220 of the latch plate is pushed upwardly from below.

As shown in FIG. 7, the front cover 24 is pivotally mounted to the back plate 26 about a lower end at laterally spaced pivot points 238. When the locking system is released, the front cover rotates downward around the pivot points 238, providing access to the container 12 and the pathway 10.

To insert a fresh reservoir B into the dispenser, the front cover 24 is opened by releasing the locking system.

The reservoir is positioned such that the undulating portion 208 of the container is aligned with the undulating shelf portion 206. The pathway 10 is inserted into the collar 204 of the backplate. The neck 20 of the container is lowered into the collar. The collar and the backplate seat the reservoir in the correct position for dispensing and position the downstream end 38 of the pathway for receipt by the retaining portion 160 of the platen when the front cover is closed.

Figure 13:
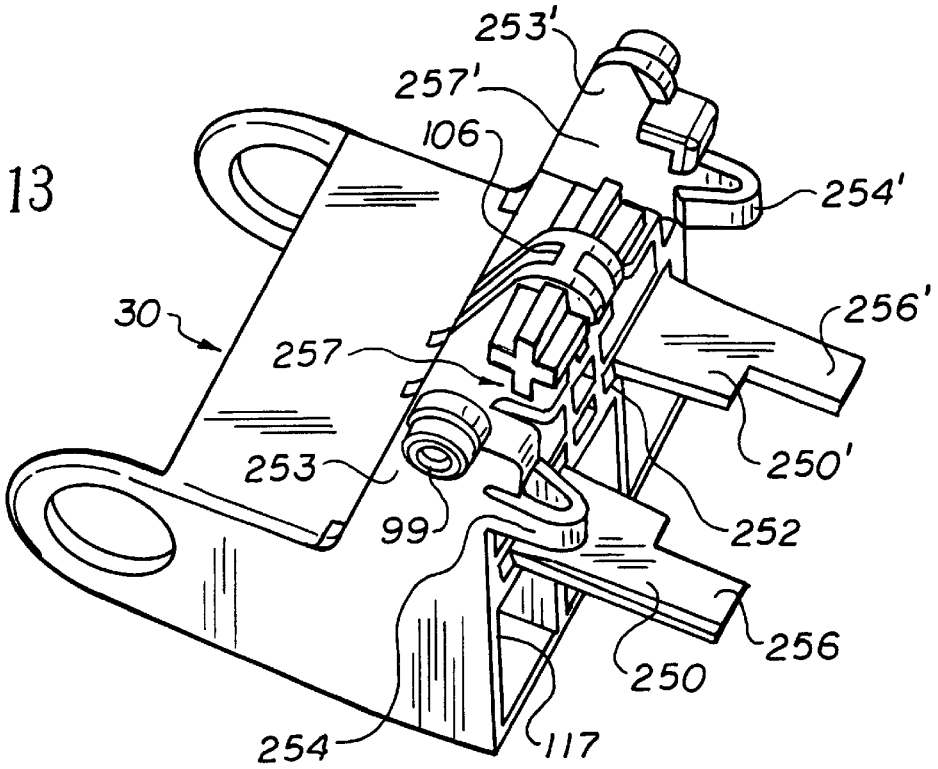
FIG. 13 is an enlarged top perspective view of the roller assembly of FIG. 1 prior to insertion of the roller assembly in the dispenser; and, FIG. 14 is an enlarged rear perspective view of the roller assembly of FIG. 1 with folding blades engaged as they would be after insertion of the roller assembly into the dispenser.
Figure 14:
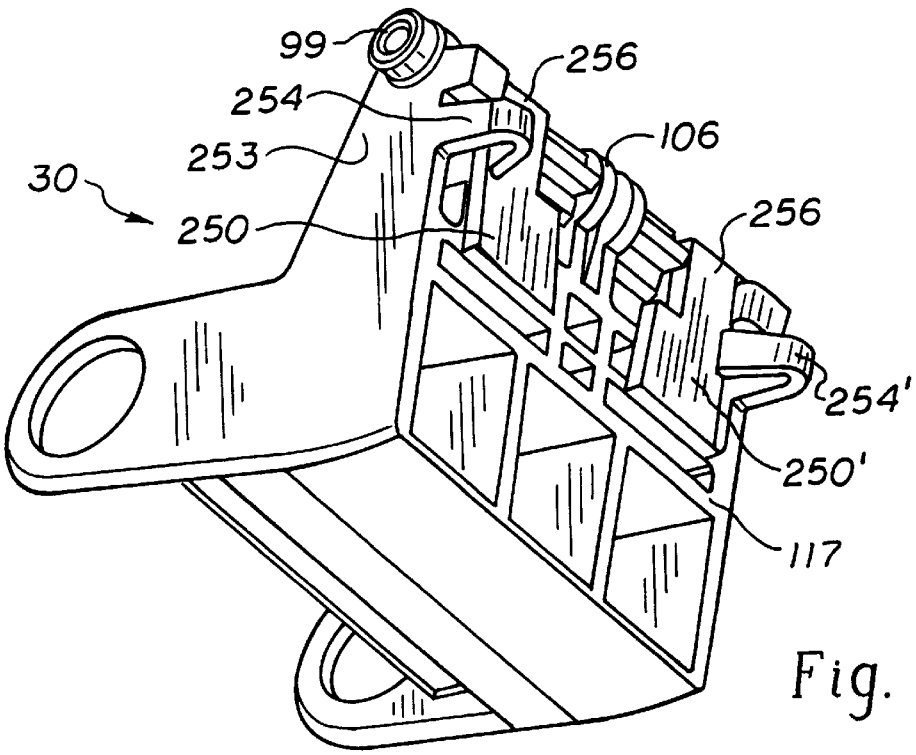

With reference to FIGS. 10, 13, and 14, the roller assembly 30 includes a pair of folding blades 250 and 250' for locking the roller assembly to the back plate 26. Prior to insertion of the roller assembly into the backplate, the blades extend horizontally from the rearward facing surface 117 of the roller assembly. Preferably, the blades are attached to the rear face by hinges, such as thinned regions 252, which allow the blades to be folded upward until they lie flat against the rear face of the roller assembly, as shown in FIG. 14. With the blades extending rearwards, the pivot pins 99 are connected to the back plate by insertion through laterally spaced openings in the back plate at the pivot points 100. The pivot pins are attached to resiliently flexible side members 253, 253' of the roller assembly which flex inward to allow the pivot pins to be inserted into the openings. The blades are then folded upward until they are received behind corresponding resiliently flexible hooks 254 and 254' which extend rearward of the rearward facing surface 117 of the roller assembly. The hooks flex inward, away from the blades, to allow the blades to move past them, and then flex outward to inhibit unfolding of the blades. In this position, an upper portion 256,256' of each blade occupies a space 257, 257' between the corresponding side member 253, 253' and the central shaft 106 which receives the spring 104 therearound. This prevents the side members from flexing inward. Removal of the pivot pins from the openings and subsequentremoval of the roller assembly from the back plate are thereby prevented.

The invention has been described with reference to the preferred embodiment. Obviously, modifications and alterations will occur to others upon reading and understanding the preceding detailed description. It is intended that the invention be construed as including all such modifications and alterations insofar as they come within the scope of the appended claims or the equivalents thereof.

Having thus described the preferred embodiment, the invention is now claimed to be:

1. A dispenser for discharging a liquid comprising:

a housing including a front cover and a back plate;

a reservoir for containing the liquid, the reservoir removably mounted within the housing, the reservoir including:

a container, and a flexible tube connected at an upstream end to the container, a valve selectively closing a downstream end of the tube;

a roller assembly pivotally mounted in the housing, the roller assembly including a roller bar, rotatably mounted on an assembly body;

a platen moveably connected to the front cover of the housing such that pressure on the platen moves the platen towards the roller assembly, the platen compressing the upstream end of the tube between the platen and the roller bar and camming the roller bar towards the downstream end of the tube.

2. The dispenser of claim 1 wherein the tube is formed from a material that returns rapidly to its original shape when a compressive force is removed, so as to apply a pressure on the platen to return the platen quickly to an at-rest position.

3. The dispenser of claim 1 wherein the tube is formed from silicone rubber.

4. The dispenser of claim 1 wherein the valve is a self-sealing valve which extends across the downstream end of the tube, the valve being normally closed when under a pressure of the reservoir of liquid but opens when an additional pressure is applied.

5. The dispenser of claim 1, wherein the platen is pivotally connected at an upper end to the front cover of the housing.

6. The dispenser of claim 5, wherein the roller assembly and the platen are mounted for pivoting motion along a pair of parallel and physically displaced pivot axes.

7. The dispenser of claim 1, wherein the platen includes a projection which extends towards the tube, the projection including a camming surface, the camming surface being positioned such that the roller bar cams against the camming surface when pressure is exerted on the platen.

8. The dispenser of claim 7 wherein the roller assembly is angled downwards to cam the roller bar progressively down the tube as it cams against the camming surface.

9. The dispenser of claim 1 wherein the roller assembly includes:

a spring-loaded return mechanism which biases the roller assembly toward the tube with sufficient pressure to compress the tube when pressure is applied to the platen.

10. The dispenser of claim 9 wherein the roller assembly and the housing have abutting surfaces which limit interaction between the roller bar and the tube in a rest position in which the platen is not compressed.

11. The dispenser of claim 10 wherein the abutting surfaces are positioned so that the roller bar engages the tube without compressing the tube closed.

12. The dispenser of claim 1, wherein the container is formed from a non-rigid material, which collapses as the container is emptied of liquid.

13. The dispenser of claim 1, further including a filtered vent through which air enters the reservoir to replace the liquid dispensed, the vent filtering the air of airborne contaminants.

14. The dispenser of claim 13, wherein the filter is disposed in a wall of the container.

15. The dispenser of claim 1, further including a volume regulator for controlling a volume of liquid dispensed in a selected one of a plurality of discrete incremental amounts.

16. The dispenser of claim 15, wherein the volume regulator includes a plurality of stop surfaces, each of the stop surfaces corresponding to a different one of the plurality of discrete incremental amounts, the volume regulator being mountable in the housing in a plurality of positions, each position aligning a different one of the stop surfaces with a corresponding surface on the roller assembly.

17. The dispenser of claim 1, wherein the platen includes a retaining portion which is shaped to receive the downstream end of the tube.

18. The dispenser of claim 1, wherein the platen includes a flange which is shaped to engage the roller assembly and limit downward travel of the roller bar.

19. The dispenser of claim 1, wherein the roller assembly includes a pair of blades which are movable from a first position, in which the roller assembly is connectable to the back plate, and a second position, in which the roller assembly is locked to the back plate.

20. A method of dispensing an antiseptic liquid from a reservoir without drawing contaminated air into the reservoir, the method comprising:

depressing a platen mounted forwardly of a roller towards the roller to compress a flexible tube between the platen and the roller and seal off an upper portion of the tube, the tube being connected at an upper end to the reservoir of the liquid and having a valve at a lower end;

moving the roller progressively down the tube toward the downstream end, the tube being compressed progressively adjacent the roller, the roller exerting a pressure on the liquid at the downstream end of the tube which causes the valve to open to dispense the liquid; and, removing the compression on the tube adjacent the downstream end of the tube such that liquid drawn from the reservoir into the tube behind the roller remains in the tube and blocks ingress of air through the valve.

21. The method of claim 20 further including:

filtering air that enters the reservoir to replace the dispensed liquid.

* * * * *